United States Patent [19]

Inagaki et al.

[11] Patent Number: 4,487,562

[45] Date of Patent: Dec. 11, 1984

[54] ROTARY VANE TYPE COMPRESSOR

[75] Inventors: Mitsuo Inagaki, Okazaki; Kenji Takeda, Aichi; Seitoku Ito, Okazaki, all of Japan

[73] Assignee: Nippon Soken, Inc., Nishio, Japan

[21] Appl. No.: 354,435

[22] Filed: Mar. 3, 1982

[30] Foreign Application Priority Data

Mar. 23, 1981 [JP] Japan ..... 56-38927[U]
Mar. 23, 1981 [JP] Japan ..... 56-40408

[51] Int. Cl.[3] ..... F04C 29/02

[52] U.S. Cl. ..... 418/84; 418/87; 418/97

[58] Field of Search ..... 418/87, 84, 97, 98, 418/99

[56] References Cited

U.S. PATENT DOCUMENTS 3,243,103 3/1966 Bellmer ..... 418/87
3,560,120 2/1971 Gannaway ..... 418/84
4,342,547 8/1982 Yamada ..... 418/87

*Primary Examiner*—William R. Cline
*Assistant Examiner*—John J. McGlew, Jr.
*Attorney, Agent, or Firm*—Cushman, Darby & Cushman

[57] ABSTRACT

A rotary vane type compressor provided with a rotor member arranged eccentrically in the cylindrical housing. Vane plates are radially slidably arranged in the rotor member, so that the vane plates always contact an inner cylindrical surface of the housing. Valve means are provided for a positive close-off of the supply of oil during non-operation of the compressor while maintaining a supply of oil in a necessary amount during operation of the compressor. The compressor further includes an oil reservoir arranged in the rotor member for storing an amount of oil to be directed to a pair of bearing units.

5 Claims, 6 Drawing Figures

ROTARY VANE TYPE COMPRESSOR

FIELD OF THE INVENTION

The present invention relates to a rotary vane type compressor suitably adapted for use in an air conditioning apparatus for a motor vehicle.

BACKGROUND OF THE INVENTION

Known in a prior art is a rotary vane type compressor which includes a rotor arranged in a cylindrical housing having a predetermined inner surface profile, through which rotor vane plates, having a length larger than the diameter of the rotor, are slidably inserted, so that vane plates always contact, at their ends, the inner profile of the housing during the rotation of the rotor. Compressor chambers are thus formed between the vane plates, the rotor and the housing. A cooling medium is sucked into the chambers and forced from the chamber during each rotation of the rotor. The rotor has at its ends cylindrical seal portions and shaft portions adjacent to the cylindrical seal portions. The cylindrical seal portions are inserted in the respective cylindrical recesses formed in side plates, so that annular slits or clearances of very small thickness are formed between the side plates and the cylindrical seal portions. The shaft portions are supported on the side plates by means of bearing units, arranged in bearing chambers formed between the housing and the rotor. The bearing chambers are opened to the respective annular slits.

The rotor effects a high speed sliding motion with respect to the inner surface of the cylindrical housing. Thus, in order to lubricate the parts of the compressor, a means is provided for supplying the lubrication oil into the compression chambers. The oil supplied to the compression chambers leaks into the bearing chamber via the annular slits to lubricate the bearing units.

The prior art compressor suffers from a drawback in that parts comprising the compressor are apt to be destroyed due to the large force applied thereto when the compressor is started. This large force is generated by an accumulation of oil in the compression chambers on the one hand and by a pressure difference occuring between the bearing chambers on the other hand. The accumulation of oil in the compression chambers occurs because no provision is made to close the chambers in the oil supply conduit in the prior art. An extremely large pressure is generated in the chamber due to a fluid compression when starting the compressor which causes the generation of a large force, sufficient to destroy parts of compressor.

The pressure difference is caused by the independent structure of the bearing chambers in the prior art. The pressure difference becomes large when the compressor is started in a cold state under a non-equalized accumulation of oil in the bearing chambers. Due to the large pressure difference, a thrust force is applied to the rotor, causing wear of the vanes or side plates, or causing the thermal sticking of such parts. In order to overcome this drawback, a means may be provided for communicating the bearing chambers with the compression chambers, so that the pressure in the chambers is equalized. However, the leakage of the coolant medium from the compression chambers to the bearing chambers, or the leakage of oil from the bearing chambers to the compression chambers takes place due to the existence of the annular slits in the cylindrical seal portions of the rotor member. Due to such leakage, the compression efficiency is decreased.

SUMMARY OF THE INVENTION

An object of the present invention is to provide a rotary vane type compressor capable of overcoming the above-mentioned various drawbacks in the prior art.

According to the present invention a rotary vane type compressor is provided, which comprises:

a casing assembly having an inner cylindrical surface of a predetermined profile;

a rotor member eccentrically arranged in the casing so that the rotor contacts the inner cylindrical surface of the casing;

a bearing means for rotatably supporting the rotor member in the casing assembly;

at least one vane plate;

said rotor member being provided with at least one slit extending radially through the rotor member, the vane plate being slidably inserted in the slit, the vane plate having ends which always contact the inner cylindrical surface of the casing assembly, so that compression chambers, the volume of each of which chambers increases and then decreases during each rotation of the rotor member, are formed between the casing assembly, the vane plate and the rotor member;

an inlet means opened to the compression chambers which chambers increase in volume for the introduction of the cooling medium in a gaseous state;

an outlet means opened to the compression chambers which chambers decrease in volume for the discharge of the cooling medium;

a separator means connected to the outlet means for separating the lubricant oil from the cooling medium;

oil supply port means for the introduction of oil into the compression chambers, said port mean being opened to each of the chambers at a position under a pressure near the intake pressure;

a passageway means connecting the separator means and the oil supply port means with each other for the transmission of oil from the separator means to the port means; and valve means, responsive to a low pressure corresponding to an intake pressure at the inlet, a high pressure corresponding to a delivery pressure at the outlet and a medium pressure located between the low and the high pressure, for controlling the flow of fluid in the passageway means in accordance with the operation conditions of the compressor.

BRIEF DESCRIPTION OF ATTACHED DRAWINGS

Figure 5A:
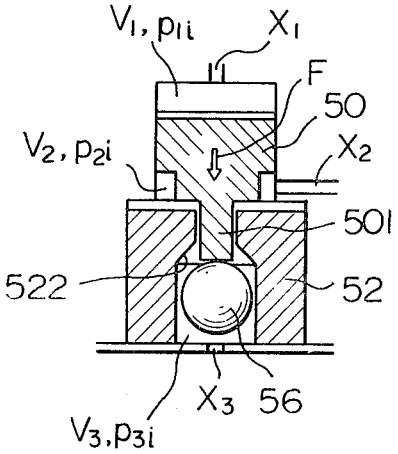
Figure 5B:
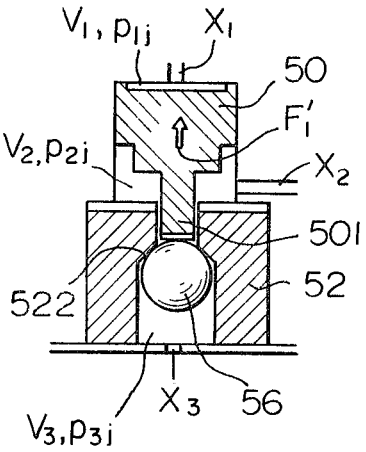

FIGS. 5 (*a*) and (*b*) are schematic views, illustrating operations of the spool valve according to the invention.

DESCRIPTION OF A PREFERRED EMBODIMENT

Referring to FIGS. 1 through 4, indicating a rotary compressor according to the invention, reference numeral 10 indicates a rotor provided with two slits 10A extending radially through the rotor 10. The slits 10A have axes intersecting each other at a right angle. Vanes 12, having a length longer than the diameter of the rotor 10, are inserted into the respective slits 10A. The vanes have shapes allowing relative slide movement of the vane plate with each other. Reference numeral 14 designates a rotor housing in which the rotor 10 is arranged. The rotor housing 14 has an inner surface of a specific profile for always allowing contact of the ends of the vanes when the rotor 10 is rotated in the housing 14. Side plates 16 and 18 are arranged on the sides of the rotor housing 14.

Figure 2:
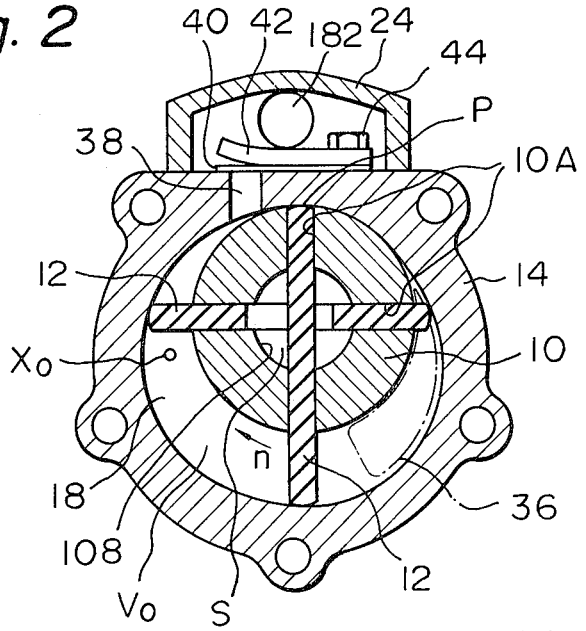
FIG. 2 is a lateral cross-sectional view, taken along line II—II in FIG. 1.

As shown in FIG. 2, the housing 14 is arranged around the rotor 10 in an eccentric manner, so that the rotor 10 contacts the housing 14 at a point P shown in FIG. 2. Thus, compression chambers $V_0$ are formed between the rotor 10, the vane plates 12, the rotor housing 14, and the side plates 16 and 18. The volume of each of the chambers $V_0$ increases and then decreases during each rotation of the rotor 10, as shown by an arrow n in FIG. 2.

The compressor includes a front housing 20 adjoining the side plate 16, an oil separator housing 22 adjoining the side plate 18, and a valve housing 24 located between the side plates 16 and 18. The housing 14, the side plates 16 and 18, and the housings 20, 22 and 24 are fixedly connected with each other by means of bolts 26 and nuts 28, so as to provide a single casing assembly. The rotor 10, at its ends, is provided with a pair of cylindric al portions 101 and 102 and a pair of shaft portions 103 and 104. A pair of bearing units 30 and 32 serve to rotatably support the shaft portions 103 and 104 on the side plates 16 and 18, respectively. The cylindrical seal portions 101 and 102 are sealingly fitted to respective cylindrical recesses 161 and 181 in the side plates 16 and 18, respectively. Adjacent to the bearing unit 30, a shaft seal unit 34 is provided. The side plate 16 is, as shown in FIG. 2, provided with an inlet port 36. The inlet port 36 is opened to each compression chamber $V_0$ during its increase in volume, so that a coolant medium, in a gaseous state to be compressed from a source (not shown), is introduced into the chambers $V_0$. The rotor housing 14 is provided with an outlet port 38. The outlet port 38 is opened to each compression chamber $V_0$ during its decrease in volume, so that the compressed coolant medium from the chambers $V_0$ is discharged through the outlet port 38. The valve housing 24 is provided with a one-way reed-type valve 40. The valve 40 is, together with a stopper plate 42 on one end thereof, fixedly connected to the housing 14 by means of a bolt 44. The other end of the reed valve 40, due to its resiliency, normally closes the outlet port 38. The valve 40 is, via an opening 182 in the side plate 18, connected to a separator housing 22.

The separator housing 22 is provided with an outlet port 221 for supplying the compressed coolant medium to an air condition system, not shown, of a vehicle. In the separator housing 22, the lubricant oil is separated from the coolant medium and is stored at the bottom of the housing 22, as shown by reference numeral 55 in FIG. 1.

Figure 1:
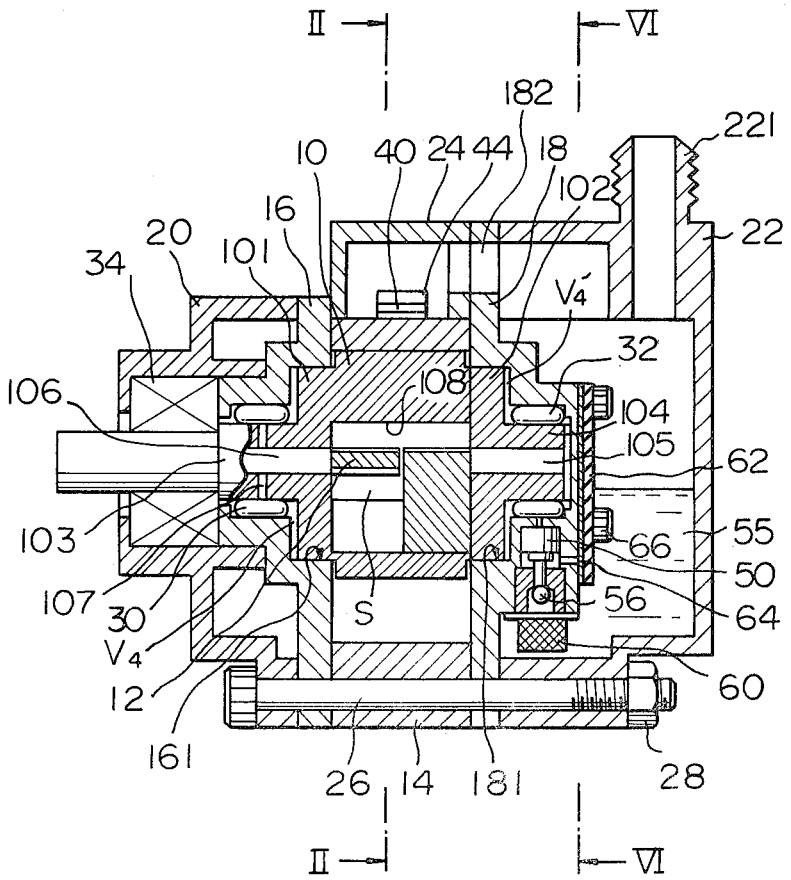
FIG. 1 is a longitudinal cross-sectional view of a rotary vane type compressor according to the present invention.

As shown by FIG. 1, a pair of bearing chambers $V_4$ and $V_4'$ are formed between the side plate 16, the seal portion 101 and the shaft portion 103, and between the side plate 18, the seal portion 102 and the shaft portion 104, respectively. The bearing units 30 and 32 are arranged in the bearing chambers $V_4$ and $V_4'$, respectively. The cylindrical seal portions 101 and 102 are closely fitted to the respective cylindrical recess 161 and 181 in the side plates 16 and 18, respectively, so that a substantial fluid tight construction of the compression chambers $V_0$ is attained. However, a controlled amount of oil from the chambers $V_0$ can be passed through annular clearances, formed between the cylindrical seal portions 101 and 102 and the cylindrical recess 161 and 181, respectively, toward the bearing chambers $V_4$ and $V_4'$. Thus, lubrication of the bearing units 30 and 32 is attained as will be fully described later.

Figure 3:
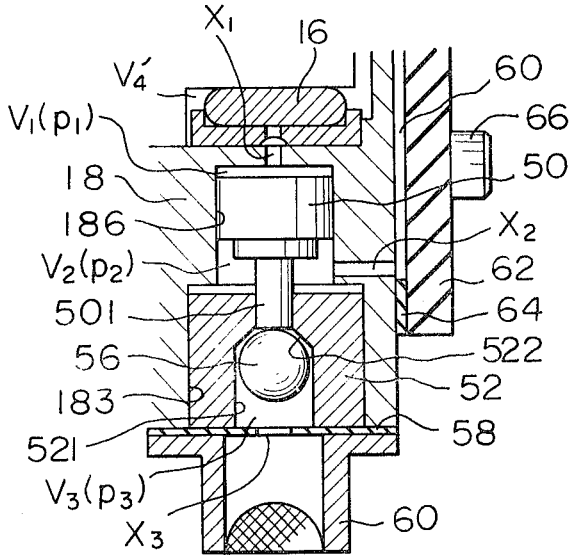
FIG. 3 is an enlarged view of spool valve in FIG. 1.
Figure 4:
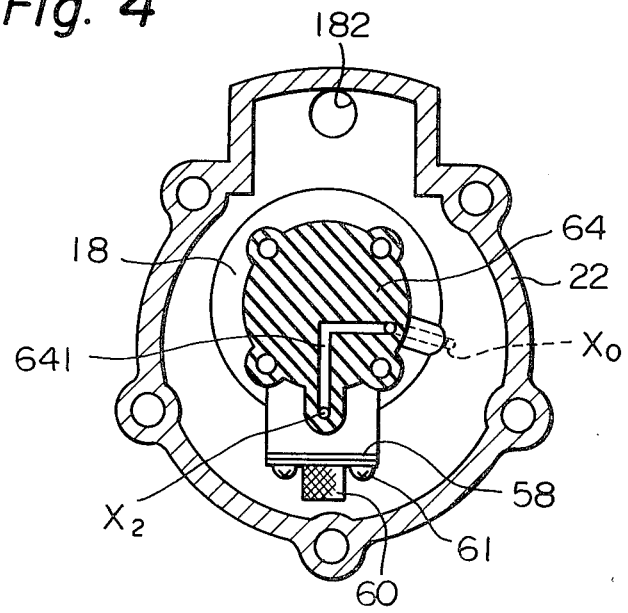
FIG. 4 is a lateral cross-sectional view, taken along line VI—VI in FIG. 1.

According to the present invention, an oil supply device is provided for supplying an amount of oil to the parts of the compressor. The oil supply device is, as will be described later, operated in response to a low pressure, corresponding to an inlet pressure, a high pressure, corresponding to an outlet pressure, and an intermediate pressure, corresponding to a pressure inbetween the high and the low pressure, in order to control the introduction of the lubrication oil into the compression chambers $V_0$. As shown in FIG. 3, the side plate 18 forms a cylinder bore 186 to which a spool valve 50 is slidably inserted in a fluid tight manner. The side plate 18 forms a cylindrical recess 183 adjoining the cylindrical bore 182. A bushing 52 is fitted to the cylindrical bore 186, in which bushing 52 a cylindrical bore 521, having a tapered upper end 522, is formed. The spool valve 50 has at its bottom a rod portion 501 which extends to the cylindrical bore 521 via the bushing 52, so that a restricted oil passageway is formed between the bushing 52 and the rod 501 for allowing the passage of a limited amount of oil therethrough. A ball valve 56 is arranged in the bushing 52 so as to face a bottom end of the rod portion 501. An oil filter 60 is, via a gasket 58, connected to the side plate 18 by bolts 61 (FIG. 4) at a position below the bushing 52. The oil filter 60 is opened to the oil 55 stored in the separator housing 22 at a position near the bottom thereof.

A chamber $V_1$ is formed above the spool valve 50 in the cylinder bore, which chamber $V_1$ is connected to the bearing chamber $V_4'$ via a medium pressure port $X_1$. A chamber $V_2$ is formed below the spool valve 50. The chamber $V_2$ is connected via the low pressure port $X_2$ to an oil passageway 61 connected to an oil supply port $X_0$. The oil supply port $X_0$ is opened to every one compression chamber at a position which is under a low pressure near an intake pressure of coolant medium. The passageway 61 is formed by a groove 641 (FIG. 4) formed in the gasket 64 covered by a plate 62. The plate 62 is fixed to the side plate 18 via the gasket 64 by means of bolts 66. A chamber $V_3$ is formed in the bushing 52. The chamber $V_3$ is via high pressure port $X_3$ in the gasket 58 connected to the oil filter 60 to receive a high pressure oil 55 stored in the separator housing 22.

The rotor 10 has, as shown in FIGS. 1 and 2, an oil reservoir S for storing a lubricant oil to be supplied to the bearing chambers $V_4$ and $V_4'$. According to the embodiment shown in the drawings, the space S is formed by a bore 108 in the rotor member 10 at the center of the rotor 10 at a position when the vanes 12 intersect each other. The oil reservoir space S communicates with the bearing chamber $V_4'$ via a longitudinal bore 105 in the shaft portion 104, and with the bearing chamber $V_4$ via a longitudinal bore 106 and radial bores 107 in the shaft portion 103. The oil reservoir has a size capable to store an amount of oil sufficient to effectively lubricate the bearing units 30 and 32.

Now the operation of the present invention will be described.

A cooling medium in a gaseous state is, from the inlet port 36, introduced into the compression chambers $V_0$ when the rotor 10 is rotated as shown by an arrow n in FIG. 2. The cooling medium contained in the compression chambers $V_0$ is, during the rotation of the rotor, compressed, so that the cooling medium is forced out of the chambers $V_0$ into the outlet port 38. The pressure of cooling medium acts on the one-way valve 40 causing it to open, so that the cooling medium is forced into the separating housing 22 via the delivery passageway 182. A liquid-gas separation process takes place in the housing 22, so that the lubrication oil, included in the cooling medium, is separated and deposited at the bottom of the housing 22, as shown by the reference numeral 55. Thus, oil separated from the gaseous state cooling medium is supplied to a system (not shown) for carrying out the refrigeration cycle via the port 221.

The lubrication oil is, during the above operation of the compressor, introduced into the compression chambers from the oil supply port $X_0$ for lubricating the parts of the compressor. Such supply of the lubrication oil is controlled by the slide valve 50 according to the present invention, as will be fully described hereinbelow.

In FIG. 3, the chamber $V_1$ located above the spool valve 50, to which the medium pressure port $X_1$ is opened, is under a pressure $p_1$ which is equal to the pressure in the bearing chamber $V_4$. The chamber $V_2$ located below the spool valve 50, to which the loW pressure port $X_2$ is opened, is under a pressure $p_2$ which is equal to the low pressure at the oil supply port $X_0$. The chamber $V_3$ to which the high pressure port $X_3$ is opened, is under a pressure $p_3$, which is equal to the high pressure in the separator housing 22.

A position of the valve 50 is schematically shown in FIG. 5(*a*), when the rotary compressor is under operation. In this case, a force F is generated in the spool valve 50 for urging the spool valve 50 downwardly. This force is expressed by the following equation.

$$F = p_{1i}A - p_{2i}(A - B) - p_{3i}B \quad (1)$$

where A is a cross-sectional area of the spool valve 50;

B is a cross-sectional area of the rod 501, and;

i is subscript indicating the compressor under operation.

The pressure $p_{1i}$ in the chamber $V_1$ connected to the bearing chamber $V_4'$ is, as well known, under a pressure which is expressed by the following equation.

$$p_{1i} \text{ approximately } = \frac{p_{2i} + p_{3i}}{2} \quad (2)$$

Thus, the following equation is obtained by substituting the equation (2) into the equation (1).

$$F = \frac{1}{2}(p_{3i} - p_{2i})(A - 2B) \quad (3)$$

Since the $A >> 2B$, the force F urging the spool downwardly is large enough to cause the ball valve 56 to be detached from the tapered upper end 522. A controlled amount of oil is, under the effect of the pressure difference ($p_{3i}$–$p_{2i}$), introduced into the chamber $V_2$ via the clearance formed between the rod 501 and the bushing 52. The oil is, via the low pressure port $X_2$, the oil supply conduit 60 and the oil supply port $X_0$, introduced into the compression chambers $V_0$ in order to lubricate the parts 10 and 12 of the compressor. The oil in the compression chambers $V_0$ is, via the clearance formed by the cylindrical portions 101 and 102, caused to leak into the bearing chambers $V_4$ and $V_4'$, respectively, for lubricating the bearing members 30 and 32.

It should be noted that the oil reservoir space S (FIGS. 1 and 2) in the rotor 10 is adapted for communicating the bearing chambers $V_4$ and $V_4'$ with each other. Thus, the space S always has an amount of oil sufficient enough to lubricate both of the bearing units 30 and 32, even if the amount of oil passed through the clearance is small. It should be also noted that, due to the constant connection of the bearing chambers $V_4$ and $V_4'$, the pressure in one of the chambers is always equalized to the pressure of the other chamber during each operation of the compressor. Thus, generation of an undesired thrust force in the rotor is prevented. Thus, wearing of the vanes 12 or rotor due to such force is prevented.

The operation of the valve when the compressor is stopped is shown in FIG. 5(*b*). In this case, the force $F_1'$, which causes the spool valve 50 to move upwardly, is generated and is indicated by the following equation.

$$F = p_{3j}B + p_{2j}(A - B) - p_{ij}A \quad (4)$$

when the compressor is stopped, the pressure $p_{1j}$ corresponding to that in the bearing chambers is equal to the pressure $p_{2j}$ corresponding to the intake pressure, since the separator is disconnected from the compression chambers $V_0$ ($p_{1j}=p_{2j}$). Thus, the equation (4) becomes $$F = (p_{3j} - p_{2j})B \quad (5)$$

This equation means that spool valve 50 is displaced upwardly, to allow the ball valve 56 to be seated on the tapered upper end 522 due to the strong force obtained by the equation (5). Thus, the supply of oil during the stopping of the compressor is positively prevented. Thus, a generation of an undesired large force, which may destruct the parts of the compressor, may be prevented when the compressor is re-started. Since the oil reservoir space S is located between the bearing chambers $V_4$ and $V_4'$, a pressure difference does not occur when a cold engine is started under a condition where an amount of lubricant oil is stored in the bearing chambers.

As another embodiment of the present invention, in place of the spool valve 50, a flexible member, such as a diaphragm or a bellows, may be used. For example, such member would be arranged in place of the spool valve 50 in FIG. 3. A rod 501 may be fixedly connected to the member.

As a further embodiment, in place of mounting the oil supply device in the side plate, as shown in FIG. 3, the oil supply device may be constructed as an independent assembly.

While an embodiment and modifications are described with reference to the attached drawings, many changes may be made by those skilled in this art without departing from the scope of the invention.

What is claimed is:

1. A rotary vane compressor comprising:

a casing assembly having an inner cylindrical surface of a predetermined profile;

a rotor member eccentrically arranged in the casing so that the rotor contacts the inner cylindrical surface of the casing;

a bearing means for rotatably supporting the rotor member in the casing assembly;

at least one vane plate;

said rotor member being provided with at least one slit extending radially through the rotor member, the vane plate being slidably inserted in the slit, the vane plate having ends which always contact the inner cylindrical surface of the casing assembly, so that compression chambers, the volume of each of which chambers increases and then decreases during each rotation of the rotor member, are formed between the casing assembly, the vane plate and the rotor member;

an inlet mean opened to the compression chambers which chambers increase in volume for the introduction of the cooling meduim in a gaseous state;

an outlet means opened to the compression chambers which chambers decrease in volume for the discharge of the cooling medium;

a separator means connected to the outlet means for sepatating the lubricant oil from the cooling medium;

said casing having an oil supply port means for the introduction of oil into the compression chambers, said port means being opened to the chambers at a position which is under a pressure near the intake pressure;

a passageway means connecting the separator means and the oil supply port means with each other for the transmission of oil from the separator to the port means, and valve means for controlling the flow of fluid in said passageway means in accordance with the operating conditions of the compressor comprising a valve member movably arranged in the casing assembly, said valve member forming on one side a first chamber receiving the pressure in said bearing means and on the other side a second chamber receiving the pressure near the intake pressure, and means for forming a restricted orifice introducing the pressure in the separator means to said second chamber when the compressor is being operated.

2. A rotary compressor according to claim 1, wherein said valve member is formed as a spool valve which is slidably inserted in the casing.

3. A rotary compressor according to claim 1, wherein said means for forming a restricted orifice comprises a rod which is connected to the valve member, a bushing fixedly arranged in the casing, through which bushing the rod freely passes so that a passageway is formed between the bushing and the rod for allowing a flow of a limited amount of oil, and a second valve member responsive to the high pressure in the separator means for selectively connecting the passageway to the separator.

4. A rotary compressor according to claim 3, wherein said second valve member is formed as a ball facing a valve seat in the bushing.

5. A rotary compressor according to claim 3, further comprising an oil filter which is on one end connected to the separator and on the other end opened to the second valve member.

* * * * *